US007653960B2

(12) United States Patent
Lee

(10) Patent No.: US 7,653,960 B2
(45) Date of Patent: Feb. 2, 2010

(54) CLEANING BRUSH STRUCTURE

(75) Inventor: Pei Yuan Lee, Changhua Hsien (TW)

(73) Assignee: Rock Tone Enterprise Co., Ltd., Changhua Hsien (TW)

( * ) Notice: Subject to any disclaimer, the term of this patent is extended or adjusted under 35 U.S.C. 154(b) by 815 days.

(21) Appl. No.: 11/291,922

(22) Filed: Dec. 2, 2005

(65) Prior Publication Data

US 2007/0124882 A1 Jun. 7, 2007

(51) Int. Cl.
*A46B 9/10* (2006.01)

(52) U.S. Cl. ..... 15/184

(58) Field of Classification Search ..... 15/184, 15/201, 430, 429, 214, 441, 433, 168, 169
See application file for complete search history.

(56) References Cited

U.S. PATENT DOCUMENTS 1,396,395 A * 11/1921 Beck ..... 15/429
2,071,747 A * 2/1937 Houlihan ..... 401/83
2,674,001 A * 4/1954 Abrams et al. ..... 15/184
4,842,132 A * 6/1989 Wells ..... 206/229
5,993,560 A * 11/1999 Wasak et al. ..... 134/6
6,226,828 B1 * 5/2001 Lin ..... 15/184
6,725,496 B2 * 4/2004 Chang ..... 15/184

* cited by examiner

*Primary Examiner*—Gary K Graham
(74) *Attorney, Agent, or Firm*—Senniger Powers LLP

(57) ABSTRACT

A cleaning brush structure comprises an outer sheath mounted to the outer side of an inner sheath, and an actuating body wherein the outer sheath has an elongated positioning slot communicating with an insert hole of the inner sheath for the engagement of an insert portion of the actuating body therewith. Both inner longitudinal edges of the positioning slot thereof has protrusive points and concaved points alternatively arranged in a symmetrical manner thereon to form narrower restraining space and wider accommodation space for stable location of a positioning section of the insert portion to provide a stepwise adjustment effect thereby. The actuating body also has a guiding push plate of various pattern attached thereto, and depending on the depth and area of the article to be cleaned, the inner sheath can be adjusted stepwise to ensure an accurate extension of a brush body released for the cleaning operation thereof.

19 Claims, 7 Drawing Sheets

CLEANING BRUSH STRUCTURE

BACKGROUND OF THE INVENTION

The present invention is related to a cleaning brush structure, comprising an outer sheath, an inner sheath, and an actuating body wherein the outer sheath has a positioning slot with protrusive and concaved points symmetrically extending at the longitudinal inner edges thereon to form narrower restraining space and wider accommodation space for precise abutting location of a positioning section of the actuation body therein; whereby, depending on the depth and area of the article to be cleaned, the inner sheath can be adjusted in a stepwise manner to accurately control the length of a brush body released for use. Besides, the actuating body can be easily dismantled for replacement, increasing the flexibility of assembly thereof as well as prolonging the lifetime of the cleaning brush in application.

Please refer to FIG. 1. A conventional cleaning brush structure comprises an outer sheath 10, an inner sheath 20, and a brush body 30 wherein the outer sheath 10 is made in an elongated oval-shaped column, having an engaging port 11 opened at one end thereon, a sliding groove 12 of an appropriate length cut at the circumferential surface of the elongated side thereon, and a positioning hole 13 disposed at one end edge of the sliding groove 12 thereof. The inner sheath 20 has a positioning plate 21 protruding at one end thereon, and a positioning head 22 attached at the top edge of the positioning plate 21 thereon. The brush body 30 is fixedly joined to one end of the inner sheath 20 thereof.

In assembly, the positioning plate 21 of the inner sheath 20 is correspondingly aligned with the engaging port 11 of the outer sheath 10, and the positioning head 22 is pushed downward by force to be squeezed into the outer sheath 10 thereby. Meanwhile, the inner sheath 20 can be mounted into the engaging port 11 of the outer sheath 10 till the positioning head 22 flexibly projects out from the sliding groove 12 to complete the assembly thereof.

There are some drawbacks to such conventional cleaning brush structure. First, the brush body 30 is either completely exposed outside or received inside the outer sheath 10 thereof. Thus, the brush body 30 is inflexibly revealed in a fixed length for cleaning articles of different areas and depth. Second, the positioning head 22 is located in the positioning hole 13 with some extra gap revealed there-between, which can cause the positioning head 22 to shake unstably. Besides, both side edges of the positioning hole 13 are defined by smooth edges, which, in addition to providing poor positioning effect thereof, can make the positioning head 22 unstably sliding around in the cleaning operation thereof. Thus, the brush body 30 affected by force applied thereto tends to be squeezed backwards into the outer sheath 10, and the positioning head 22 must be repeatedly pushed outwards to relocate the brush body 30, which is quite inconvenient in the cleaning operation thereof. Third, the positioning head 22 must be repeatedly pressed and squeezed for the assembly or dismantling operation thereof, which, over long time of application, can result in the fatigue of the flexibility of the positioning plate 21 and make it easily broken or worn out of use.

SUMMARY OF THE PRESENT INVENTION

It is, therefore, the primary purpose of the present invention to provide a cleaning brush structure, comprising an outer sheath, an inner sheath, and an actuating body wherein the outer sheath is provided with an elongated positioning slot having alternatively-arranged protrusive and concaved points symmetrically extending at both longitudinal inner edges thereon to form narrower restraining space and wider accommodation space so that a positioning section of the actuation body can be stably located therein without sliding around to ensure an accurate extension of a brush body released in a desirable length for the cleaning operation thereof.

It is, therefore, the second purpose of the present invention to provide a cleaning brush structure wherein the actuating body has an insert portion that can be easily dismounted from an insert hole of the inner sheath for replacement thereof, which not only provide the benefit of flexible assembly but can also avoid the squeezing operation of the conventional cleaning brush above so as to prolong the life time of the cleaning brush and achieve the best state of application thereof.

It is, therefore, the third purpose of the present invention to provide a cleaning brush structure wherein the actuating body has a guiding push plate attached thereto that can be flexibly made into various pattern and style to cater to the demands of the market or the tastes of different-aged customers, economically boosting the competitive momentum and value of the present invention.

DETAILED DESCRIPTION OF THE PREFERRED EMBODIMENTS

Figure 1:
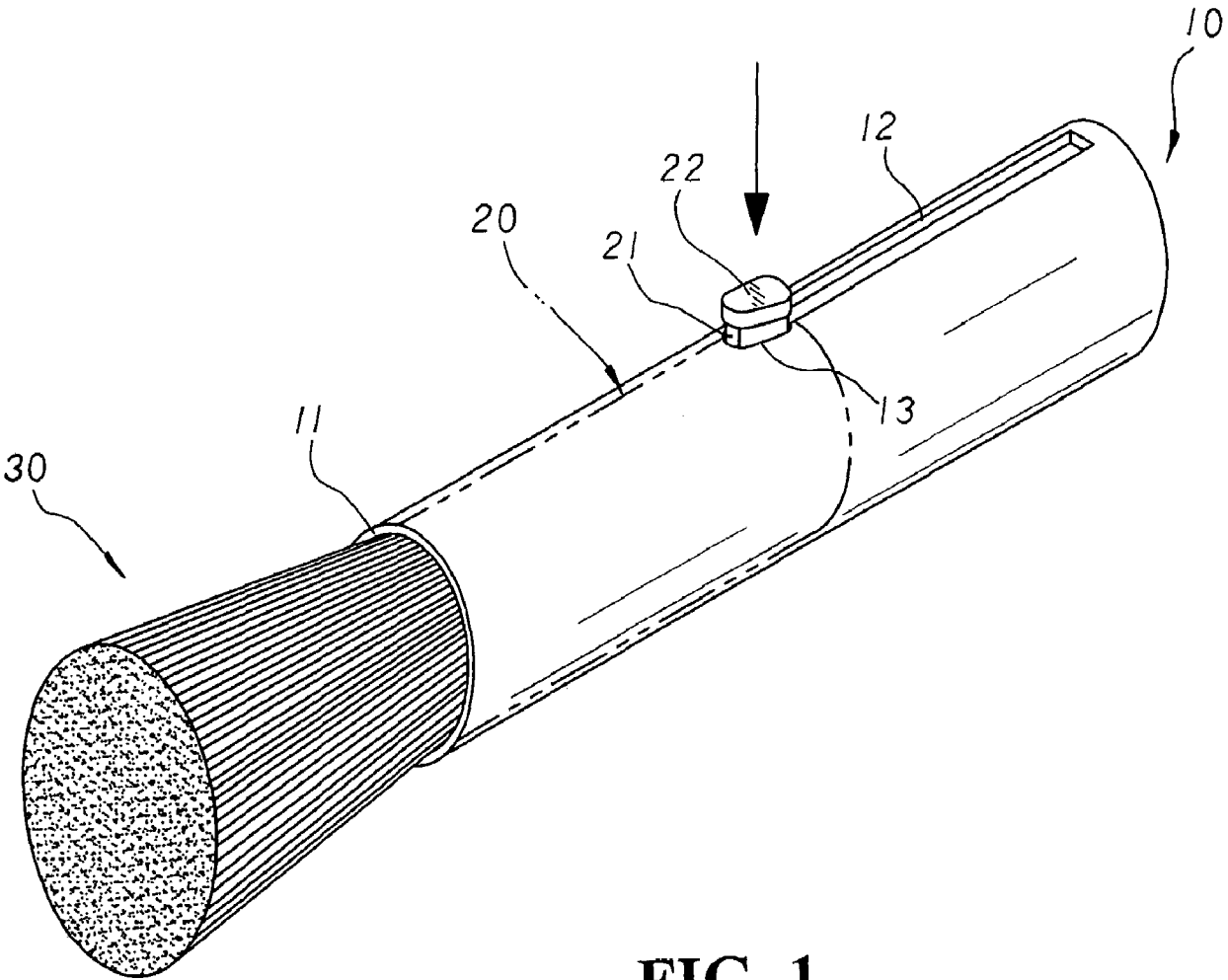
FIG. 1 PRIOR ART
FIG. 1 is an assembled perspective view of a conventional cleaning brush structure.
Figure 2:
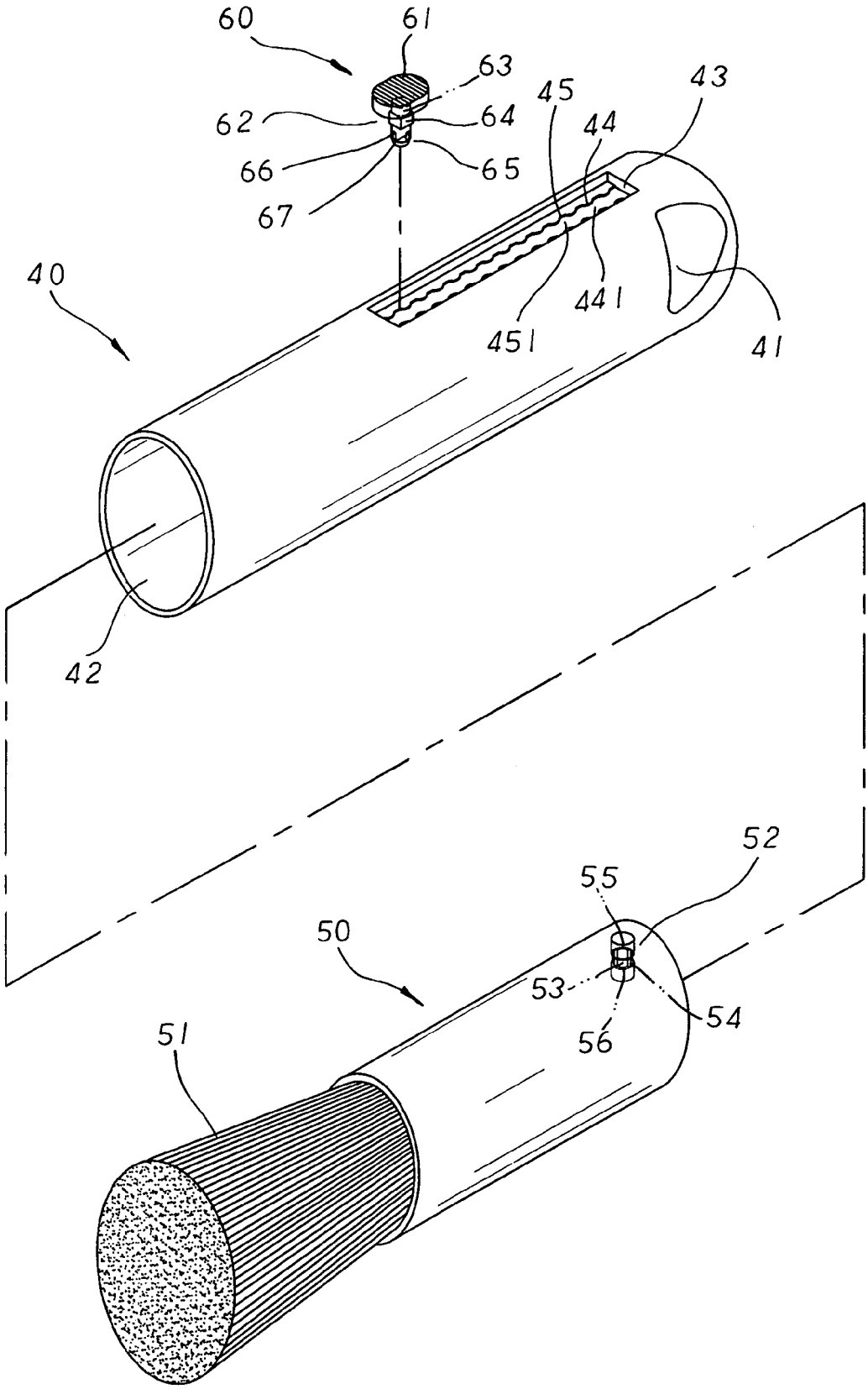
FIG. 2 is an exploded perspective view of the present invention.
Figure 3:
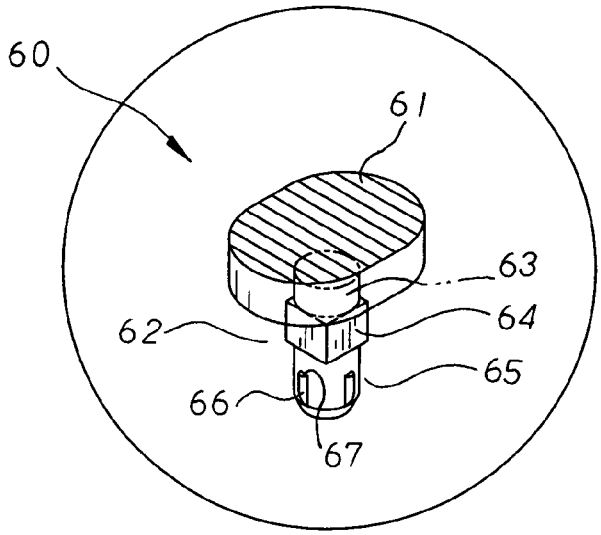
FIG. 3 is a partially enlarged view of the present invention.
Figure 4:
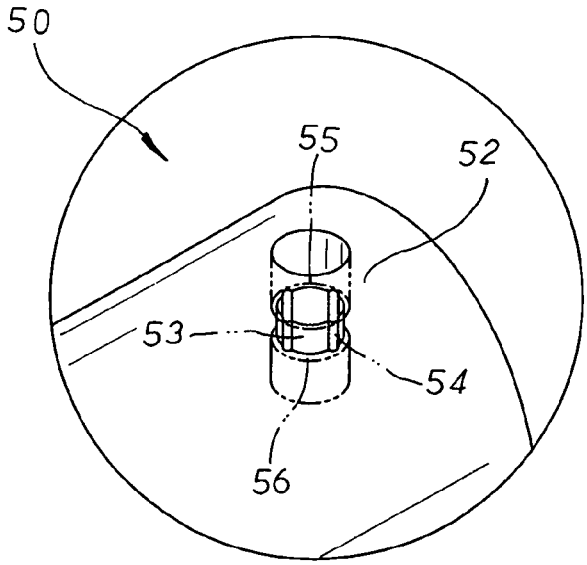
FIG. 4 is another partially enlarged view of the present invention.

Please refer to FIG. 2 showing an exploded perspective view of the present invention. The present invention is related to a cleaning brush structure, comprising an outer sheath 40, an inner sheath 50, and an actuating body 60. The outer sheath 40, composed of an enclosure end 41 disposed at one end and an opening end 42 disposed at the other end thereof, has an elongated positioning slot 43 of an appropriate length vertically cut at the circumferential surface of one side thereon, and a plurality of protrusive points 44 and concaved points 45 horizontally extending at both longitudinal inner edges of the positioning slot 43 thereon. The protrusive points 44 and the concaved points 45 are alternatively arranged in a symmetrical manner to form narrower restraining space 441 defined by the protrusive points 44 and wider accommodation space 451 defined by the concaved points 45 respectively. The outer diameter of the inner sheath 50 is smaller than the inner diameter of the outer sheath 40 thereof. The inner sheath 50 has a brush body 51 fixedly attached at one end thereon, and an insert hole 52 vertically indented at the circumferential surface of the other end thereon. The insert hole 52 (referring to FIG. 4) is equipped with a plurality of stop blocks 53 annularly protruding in the middle section thereon, and a plurality of guide recesses 54 vertically cut in the middle section thereon to separate each stop block 53 from the others thereof. Both end edges of the stop block 53 thereof are respectively defined by an upper stop face 55 and a lower stop face 56 that are formed in perpendicular to the inner wall of the insert hole 52 thereof. The actuating body 60 (referring to FIG. 3) is equipped with a guiding push plate 61, and an insert portion 62 extending at the bottom of the guiding push plate 61 thereof. The insert portion 62 is made up of a cylindrical positioning section 63 and a square-column fitting section 64 wherein the positioning section 63 has an outer diameter slightly larger than the accommodation space 451 thereof. A columned coupling section 65 is provided extending downwards from the underside of the fitting section 64, and multiple guide ribs 66 are disposed protruding at the circumferential surface of the coupling section 65 thereon. The top edge of each guide rib 66 is defined by an abutment surface 67 perpendicular to the coupling section 65 thereof.

Figure 5:
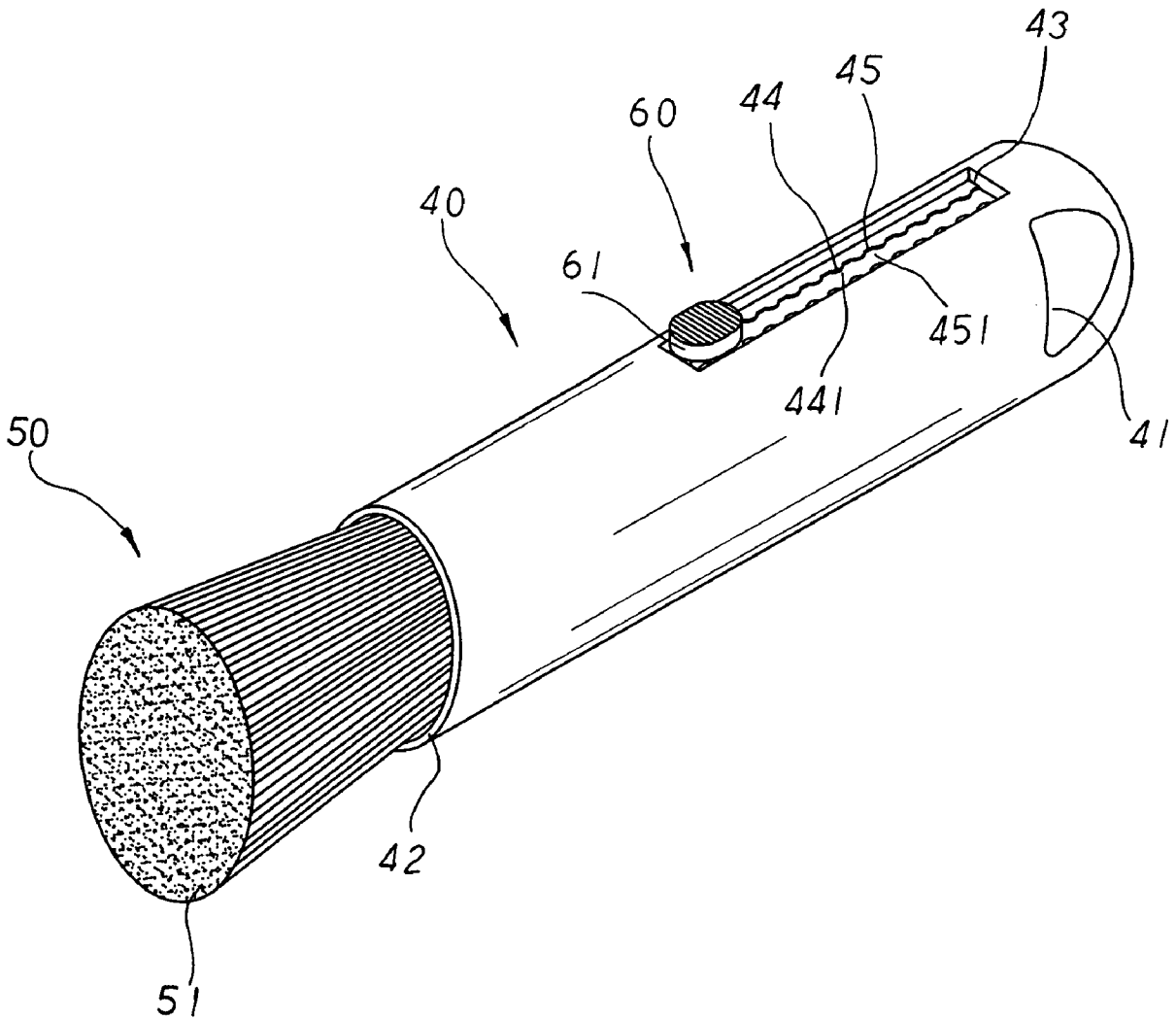
FIG. 5 is an assembled perspective view of the present invention.
Figure 6:
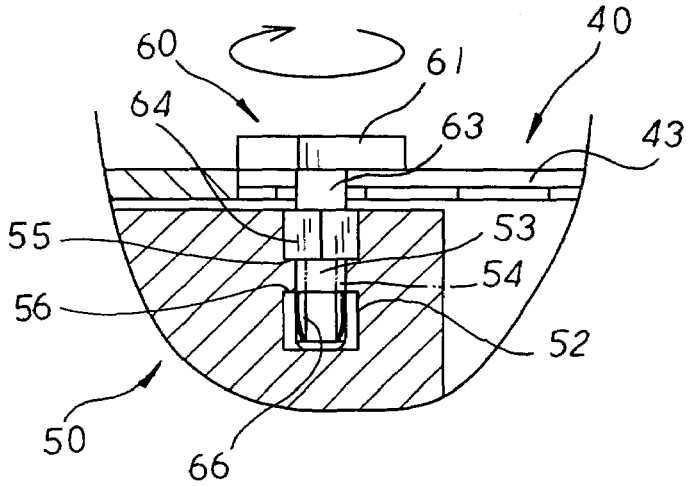
FIG. 6 is a diagram showing the present invention in assembling operation thereof.
Figure 7:
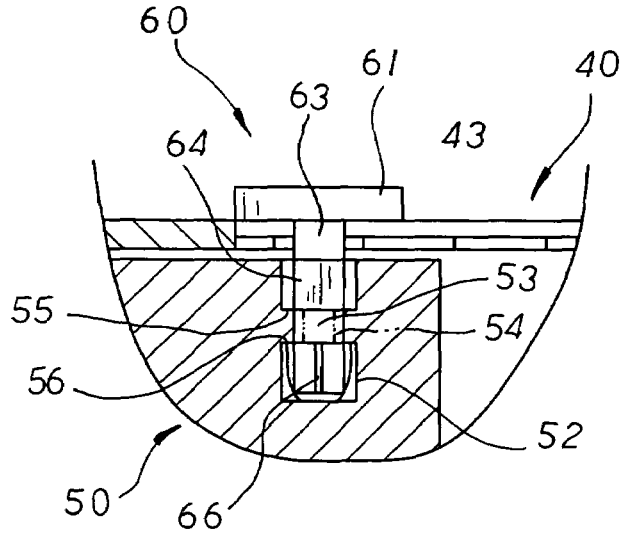
FIG. 7 is another diagram showing the present invention in assembling operation.
Figure 8:
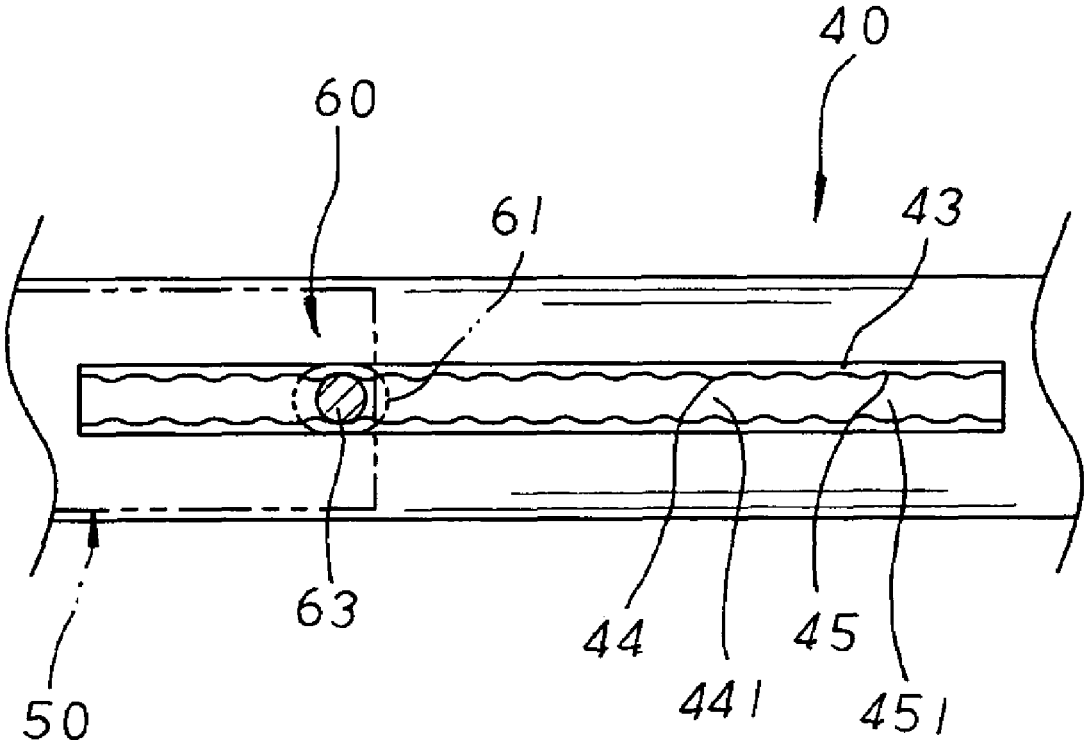
FIG. 8 is a top view of the present invention with an actuating body adjusted in position and stably held in place via protrusive and concaved points thereof.

Please refer to FIG. 5 showing an assembled perspective view of the present invention. In assembly, the insert hole 52 of the inner sheath 50 is correspondingly aligned with the positioning slot 43 of the outer sheath 40 to mount the inner sheath 50 into the outer sheath 40 till the insert hole 52 thereof is appropriately located to communicate with any spot of the positioning slot 43 thereof. Then, the insert portion 62 of the actuating body 60 (referring to FIG. 6) is guided through the positioning slot 43 to engage with the insert hole 52, permitting the guide ribs 66 of the coupling section 65 to run through the guide recesses 54 till reaching the bottom edge of the stop blocks 53 thereof respectively. Meanwhile, the fitting section 64 of the actuating body 60 is precisely abutted against the upper stop faces 55 of the stop blocks 53 thereof, and the abutment surfaces 67 of the guide ribs 66 are located slightly higher than the lower stop faces 56 of the stop blocks 53 thereof. The actuating body 60 is then rotated in about 90 degrees, permitting the abutment surfaces 67 of the guide ribs 66 to precisely contact and abut against the lower stop faces 56 thereof as shown in FIG. 7. Thus, the actuating body 60 is stably locked and positioned inside the insert hole 52 of the inner sheath 50. Moreover, the positioning section 63 of the actuating body 60 (referring to FIG. 8) is precisely located in the positioning slot 43, clamped in the accommodation space 451 defined by the concaved points 45 and limited by the restraining space 441 of the protrusive points 44 to achieve accurate positioning thereby so that the actuating body 60 can refrain from the disadvantage of unstably sliding around in cleaning operation thereof. Besides, due to the design of the positioning slot 43, the actuating body 60 can cooperatively work with the multiple protrusive and concaved points 44, 45, and move in a stepwise manner along the positioning slot 43 to provide stepwise adjustment effect thereby. Therefore, depending on the depth and area of the article to be cleaned, the guiding push plate 61 can be slid forwards or backwards accordingly to adjust the position of the inner sheath 50 step by step so as to ensure an accurate extension of the brush body 51 released in a desirable length for the cleaning operation thereof. Meanwhile, the actuating body 60 is simply twisted to one side to detach the abutment surfaces 67 of the guide ribs 66 from the lower stop faces 56 and align the guide ribs 66 with the guide recesses 54 of the insert hole 52 thereof, permitting an easy dismantling of the actuating body 60 from the inner sheath 50 and achieving the flexibility of assembly as well as dismantling thereof. Thus, the present invention improves on the squeeze-typed cleaning brush of the above-mentioned prior art and provides the best state of application thereof.

Figure 9:
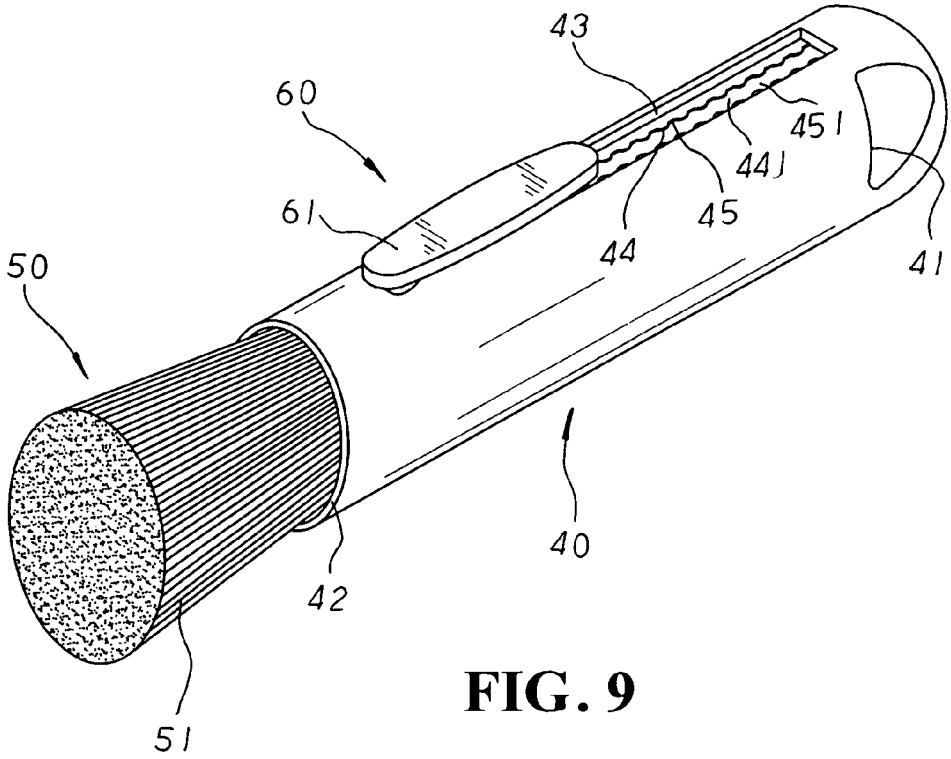
FIG. 9 is another embodiment of the present invention.
Figure 10:
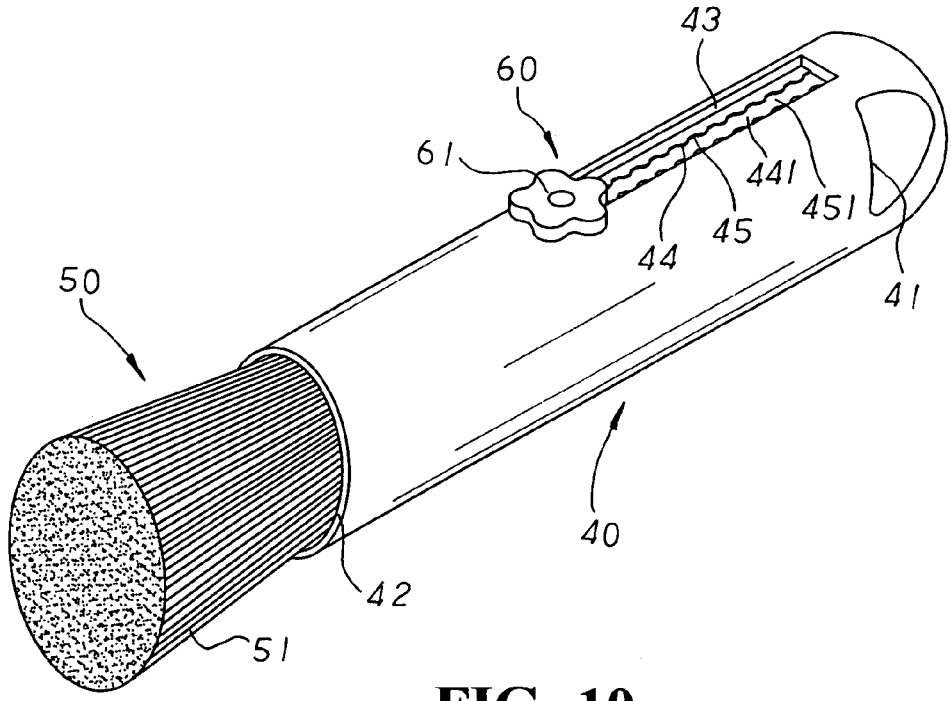
FIG. 10 is a third embodiment of the present invention.

Depending on the demands of the market and the tastes of different-aged customers, the guiding push plate 61 of the actuating body 60 can be made into various pattern and style accordingly. The guiding push plate 61 (referring to FIG. 9) can be formed into an oval-shaped plate in the form of a pen clip to be carried around by a user in application. Besides, the guiding push plate 61 (referring to FIG. 10) can also be appealingly shaped into a flower-like pattern to boost the visual effect and economically makes the present invention more competitive in the market.

What is claimed is:

1. A cleaning brush structure, comprising:

an outer sheath, an inner sheath, and an actuating body; wherein the outer sheath, mounted to an outer side of the inner sheath, has an elongated positioning slot disposed at a circumferential surface of one side thereon, and a plurality of protrusive points and concaved points horizontally extending at both longitudinal inner edges of the positioning slot thereon; the plurality of protrusive points and the concaved points of the positioning slot being alternately arranged in a symmetrical manner to form a narrower restraining space defined by the plurality of protrusive points and a wider accommodation space defined by the concaved points respectively; the inner sheath having an insert hole vertically indented at the circumferential surface of one end thereon to match with the positioning slot of the outer sheath thereby; the insert hole of the inner sheath having a plurality of stop blocks protruding in a middle section thereon, and a vertical guide recess defining each adjacent side of the stop blocks thereon respectively; the actuating body being equipped with a guiding push plate, and an insert portion with a positioning section extending at the bottom of the guiding push plate thereof to be stably fitted to the insert hole of the inner sheath thereby, the positioning section of the insert portion thereof being precisely clamped and restrained by the concaved and protrusive points of the positioning slot respectively to provide stepwise adjustment effect thereby; depending on the depth and area of the article to be cleaned, the guiding push plate being slidable forwards or backwards accordingly to adjust the position of the inner sheath step by step so as to ensure an accurate extension of a brush body released in desirable length for a cleaning operation thereof; the actuating body being stably located to avoid the risk of sliding around during the cleaning operation, and capable of being dismantled for replacement.

2. The cleaning brush structure as claimed in claim 1 wherein the outer diameter of the inner sheath is smaller than the inner diameter of the outer sheath thereof.

3. The cleaning brush structure as claimed in claim 1 wherein both end edges of each stop block of the insert hole thereof are respectively defined by an upper stop face and a lower stop face.

4. The cleaning brush structure as claimed in claim 1 wherein the guiding push plate of the actuating body is flexibly made into various pattern and style.

5. The cleaning brush structure as claimed in claim 1 wherein the guiding push plate of the actuating body is made in an oval-shaped plate to serve the function of a pen clip.

6. The cleaning brush structure as claimed in claim 1 wherein the guiding push plate of the actuating body is shaped in a flower-like configuration.

7. The cleaning brush structure as claimed in claim 1 wherein the actuating body has a fitting section extending at one side of the positioning section thereof.

8. The cleaning brush structure as claimed in claim 7 wherein the fitting section of the actuating body is shaped in a square-column configuration.

9. The cleaning brush structure as claimed in claim 7 wherein the actuating body is also equipped with a coupling section extending at one side of the fitting section thereof, and the coupling section has a plurality of guide ribs protruding at the circumferential surface thereon.

10. The cleaning brush structure as claimed in claim 9 wherein a top edge of each of the plurality of guide ribs is defined by an abutment surface perpendicular to the coupling section of the actuating body thereof.

11. The cleaning brush structure as claimed in claim 1 wherein the positioning section of the actuating body is shaped in a cylindrical-column configuration.

12. The cleaning brush structure as claimed in claim 1 wherein the position section of the actuating body has an outer diameter slightly larger than the accommodation space of the positioning slot thereof.

13. A cleaning brush structure, comprising:

an outer sheath, an inner sheath, and an actuating body having a fitting section extending at one side of the positioning section thereof and a coupling section extending at one side of the fitting section thereof, said coupling section having a plurality of guide ribs protruding at the circumferential surface thereon, wherein the outer sheath, mounted to an outer side of the inner sheath, has an elongated positioning slot disposed at a circumferential surface of one side thereon, and a plurality of protrusive points and concaved points horizontally extending at both longitudinal inner edges of the positioning slot thereon; the plurality of protrusive points and the concaved points of the positioning slot being alternately arranged in a symmetrical manner to form a narrower restraining space defined by the plurality of protrusive points and a wider accommodation space defined by the concaved points respectively; the inner sheath having an insert hole vertically indented at the circumferential surface of one end thereon to match with the positioning slot of the outer sheath thereby; the actuating body being equipped with a guiding push plate, and an insert portion with a positioning section extending at the bottom of the guiding push plate thereof to be stably fitted to the insert hole of the inner sheath thereby, the positioning section of the insert portion thereof being precisely clamped and restrained by the concaved and protrusive points of the positioning slot respectively to provide stepwise adjustment effect thereby; depending on the depth and area of the article to be cleaned, the guiding push plate being slidable forwards or backwards accordingly to adjust the position of the inner sheath step by step so as to ensure an accurate extension of a brush body released in desirable length for a cleaning operation thereof; the actuating body being stably located to avoid the risk of sliding around during the cleaning operation, and capable of being dismantled for replacement.

14. The cleaning brush structure as claimed in claim 13 wherein a top edge of each of the plurality of guide ribs is defined by an abutment surface perpendicular to the coupling section of the actuating body thereof.

15. The cleaning brush structure as claimed in claim 13 wherein the fitting section of the actuating body is shaped in a square-column configuration.

16. The cleaning brush structure as claimed in claim 13 wherein the guiding push plate of the actuating body is flexibly made into various patterns and styles comprising an oval-shaped plate to serve the function of a pen clip and a flower-like configuration.

17. The cleaning brush structure as claimed in claim 13 wherein the positioning section of the actuating body is shaped in a cylindrical-column configuration.

18. The cleaning brush structure as claimed in claim 13 wherein the position section of the actuating body has an outer diameter slightly larger than the accommodation space of the positioning slot thereof.

19. The cleaning brush structure as claimed in claim 13 wherein the outer diameter of the inner sheath is smaller than the inner diameter of the outer sheath thereof.

* * * * *

UNITED STATES PATENT AND TRADEMARK OFFICE

CERTIFICATE OF CORRECTION

PATENT NO. : 7,653,960 B2
APPLICATION NO. : 11/291922
DATED : February 2, 2010
INVENTOR(S) : Pei Yuan Lee It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1096 days.

Signed and Sealed this

Twenty-eighth Day of December, 2010

David J. Kappos

David J. Kappos
*Director of the United States Patent and Trademark Office*